US009607568B2

(12) United States Patent
Kinsho

(10) Patent No.: US 9,607,568 B2
(45) Date of Patent: Mar. 28, 2017

(54) DISPLAY PANEL DRIVER AND DISPLAY DEVICE

(71) Applicant: Synaptics Japan GK, Tokyo (JP)

(72) Inventor: Takao Kinsho, Tokyo (JP)

(73) Assignee: SYNAPTICS JAPAN GK, Tokyo (JP)

( * ) Notice: Subject to any disclaimer, the term of this patent is extended or adjusted under 35 U.S.C. 154(b) by 158 days.

(21) Appl. No.: 14/201,591

(22) Filed: Mar. 7, 2014

(65) Prior Publication Data

US 2014/0253423 A1 Sep. 11, 2014

(30) Foreign Application Priority Data

Mar. 11, 2013 (JP) ..... 2013-048481

(51) Int. Cl.
*G09G 3/36* (2006.01)

(52) U.S. Cl.
CPC ..... *G09G 3/3688* (2013.01); *G09G 3/3696* (2013.01); *G09G 2310/0291* (2013.01)

(58) Field of Classification Search
CPC ..... G09G 3/36; G09G 3/3607; G09G 3/3688; G09G 3/3696; G09G 2310/0291
USPC ..... 345/89, 147, 690
See application file for complete search history.

(56) References Cited

U.S. PATENT DOCUMENTS 6,275,207 B1 * 8/2001 Nitta ..... G09G 3/2011 345/89
7,023,458 B2 4/2006 Kudo et al.
7,126,596 B1 * 10/2006 Hogan ..... G09G 3/3688 345/208
7,193,637 B2 3/2007 Kudo et al.
7,511,693 B2 3/2009 Kudo et al.
8,120,561 B2 2/2012 Kudo et al.
8,223,099 B2 7/2012 Nishimura et al.
8,633,881 B2 1/2014 Kudo et al.
(Continued)

FOREIGN PATENT DOCUMENTS

JP 2000-242233 A 9/2000
JP 2001-188615 A 7/2001
(Continued)

OTHER PUBLICATIONS

Japanese Office Action dated Dec. 21, 2016, with an English translation.

*Primary Examiner* — Amare Mengistu
*Assistant Examiner* — Gloryvid Figueroa-Gibson
(74) *Attorney, Agent, or Firm* — McGinn IP Law Group, PLLC

(57) ABSTRACT

A display panel driver includes: a grayscale amplifier receiving an input grayscale reference voltage and generating an output grayscale reference voltage corresponding to the input grayscale reference voltage; a voltage dividing resistor receiving the output grayscale reference voltage and generating a plurality of grayscale voltages by using the received output grayscale reference voltage; a decoder circuit selecting grayscale voltages from among the plurality of grayscale voltages in response to image data and outputting the selected grayscale voltages; and an output circuit outputting drive voltages corresponding to the selected grayscale voltages to output terminals to be connected to source lines of a display panel. The grayscale amplifier is configured such that the output grayscale reference voltage is adjustable by adjusting an offset voltage of the grayscale amplifier.

12 Claims, 12 Drawing Sheets

(56) References Cited

U.S. PATENT DOCUMENTS

| | | | | |
|---|---|---|---|---|
| 9,336,733 | B2 | 5/2016 | Kudo et al. | |
| 2002/0186230 | A1* | 12/2002 | Kudo | G09G 3/3607 345/690 |
| 2008/0143665 | A1* | 6/2008 | Nishimura | G09G 3/3677 345/96 |
| 2012/0001892 | A1 | 1/2012 | Kojima | |
| 2012/0032932 | A1 | 2/2012 | Kojima | |
| 2012/0032944 | A1 | 2/2012 | Kojima | |
| 2012/0069059 | A1* | 3/2012 | Lee | G09G 3/3225 345/690 |

FOREIGN PATENT DOCUMENTS

| | | | |
|---|---|---|---|
| JP | 2001-343948 | A | 12/2001 |
| JP | 2002-366112 | A | 12/2002 |
| JP | 2007-286526 | A | 11/2007 |
| JP | 2008-111875 | A | 5/2008 |
| JP | 2008-258725 | A | 10/2008 |
| JP | 2008-268473 | A | 11/2008 |
| WO | WO 2011/092768 | A1 | 8/2011 |

* cited by examiner

DISPLAY PANEL DRIVER AND DISPLAY DEVICE

CROSS REFERENCE

This application claims priority of Japanese Patent Application No. Japanese Patent Application No. 2013-048481, filed on Mar. 11, 2013, the disclosure which is incorporated herein by reference.

TECHNICAL FIELD

The present invention relates to a display panel driver and a display device, and more particularly relates to a display panel driver configured to generate grayscale voltages by using at least one grayscale amplifier.

BACKGROUND ART

In recent years, large-sized high-resolution liquid crystal display panels have become popular not only for large-sized devices such as televisions but also for mobile terminals such as smart phones and tablet terminals. In a display device including a large-sized liquid crystal display panel, multiple driver ICs (integrated circuits) are often used to drive the liquid crystal display panel.

One factor to determine the display quality of such a liquid crystal display panel is the uniformity of grayscale voltages between or among the driver ICs which drive the source lines (which may be also referred to as data lines or signal lines) of the liquid crystal display panel. The grayscale voltages are a set of voltages used to convert digital image data into analog drive voltages.

Typical driver ICs are configured to supply voltages (which may be referred to as "grayscale reference voltages", hereinafter) generated by voltage dividing by using a first voltage dividing resistor to a second voltage dividing resistor through buffer amplifiers (which may be referred to as grayscale amplifiers), and to generate a set of grayscale voltages by voltage dividing by using the voltage dividing resistor. The set of grayscale voltages are supplied to decoders (or D/A converters) for converting the image data into the drive voltages, and the decoders outputs the grayscale voltages selected in response to the graylevels of the respective pixels indicated by the image data. Output amplifiers are used to drive the source lines to the drive voltages corresponding to the grayscale voltages outputted from the decoders. In this configuration, if there are variations in the grayscale voltages generated in the respective driver ICs, block-shaped unevenness is undesirably generated in the display image, causing deterioration in the display quality.

One cause of the variations in the grayscale voltages between or among the driver ICs is a manufacturing variance of the grayscale amplifiers, especially, variations in the offset voltages of the grayscale amplifiers. Variations in the property of the grayscale amplifiers between or among the driver ICs undesirably generate variations in the grayscale voltages between or among the driver ICs.

One possible measure to address the variations in the grayscale voltages between or among the driver ICs, which are caused by the manufacture variance of the grayscale amplifiers, is to reduce the offset voltage of each grayscale amplifier. Various techniques have been proposed to reduce the offset voltage of an amplifying circuit. Proposed approaches include reduction of the manufacturing variance by optimizing the transistor size in the differential input stage of an amplifier, appropriate layout design and the like, and cancellation of the offsets in a pseudo manner by the circuit design; however, it is difficult to completely eliminate the variations in the property of the grayscale amplifier between or among the driver ICs.

Another possible measure to address the variations in the grayscale voltages between or among the driver ICs, which are caused by the manufacture variance of the grayscale amplifiers, is to connect interconnections used to transmit the grayscale voltages within the respective driver ICs (which may be referred to as "grayscale voltage lines", hereinafter) by using interconnections provided on the liquid crystal display panel. This approach effectively reduces the variations in the grayscale voltages between or among the plurality of driver ICs; however, an unnecessary current may be generated between the driver ICs when there is a large difference in the grayscale voltage between or among the driver ICs, causing an increase in the current consumption. The increase in the current consumption due to generation of an unnecessary current is a significant problem for mobile terminals, such as cellular phones, smart phones and tablet terminals.

It should be noted that Japanese Patent Application Publications Nos. 2008-268473 A and 2008-258725 A disclose techniques for cancelling the offset of an output amplifier.

Also, Japanese Patent Application Publication No. 2008-111875 A discloses a technique for cancelling the offset voltage of an operational amplifier that is used as an output amplifier or grayscale amplifier in a pseudo manner.

Furthermore, Japanese Patent Application No. 2001-343948 A discloses a technique for offset cancelling in an output amplifier configured to generate a weight-averaged voltage of the grayscale voltages.

Furthermore, Japanese Patent Application No. 2001-188615 A discloses a technique for supplying an output voltage from an impedance conversion circuit (output amplifier) to a load capacitor without using an offset cancel circuit to generate a necessary charging voltage across the load capacitor.

Furthermore, Japanese Patent Application No. 2000-242233 A discloses a drive circuit of a display device, which selects a grayscale voltage in response to higher bits of digital image data and also controls the offset voltage of an output amplifier in response to the lower bits.

SUMMARY OF THE INVENTION

Therefore, an object of the present invention is to provide a technique for suppressing deterioration in the display quality which is potentially caused by variations in the grayscale voltages between or among a plurality of display panel drivers.

The person skilled in the art would understand other objects and technical advantages of the present invention on the basis of the following disclosure.

In an aspect of the present invention, a display panel driver includes: a grayscale amplifier receiving an input grayscale reference voltage and generating an output grayscale reference voltage corresponding to the input grayscale reference voltage; a voltage dividing resistor receiving the output grayscale reference voltage and generating a plurality of grayscale voltages by using the received output grayscale reference voltage; a decoder circuit selecting grayscale voltages from among the plurality of grayscale voltages in response to image data and outputting the selected grayscale voltages; and an output circuit outputting drive voltages corresponding to the selected grayscale voltages to output terminals to be connected to source lines of a display panel.

The grayscale amplifier is configured such that the output grayscale reference voltage is adjustable by adjusting an offset voltage of the grayscale amplifier.

In another aspect of the present invention, a display device includes a display panel and a plurality of display panel drivers. Each of the plurality of display panel drivers includes: a grayscale amplifier receiving an input grayscale reference voltage and generating an output grayscale reference voltage corresponding to the input grayscale reference voltage; a voltage dividing resistor receiving the output grayscale reference voltage and generating a plurality of grayscale voltages by using the received output grayscale reference voltage; a decoder circuit selecting grayscale voltages from among the plurality of grayscale voltages in response to image data and outputting the selected grayscale voltages; and an output circuit outputting drive voltages corresponding to the selected grayscale voltages to output terminals to be connected to source lines of the display panel. The grayscale amplifier is configured such that the output grayscale reference voltage is adjustable by adjusting an offset voltage of the grayscale amplifier.

DESCRIPTION OF PREFERRED EMBODIMENTS

First Embodiment

Figure 1:
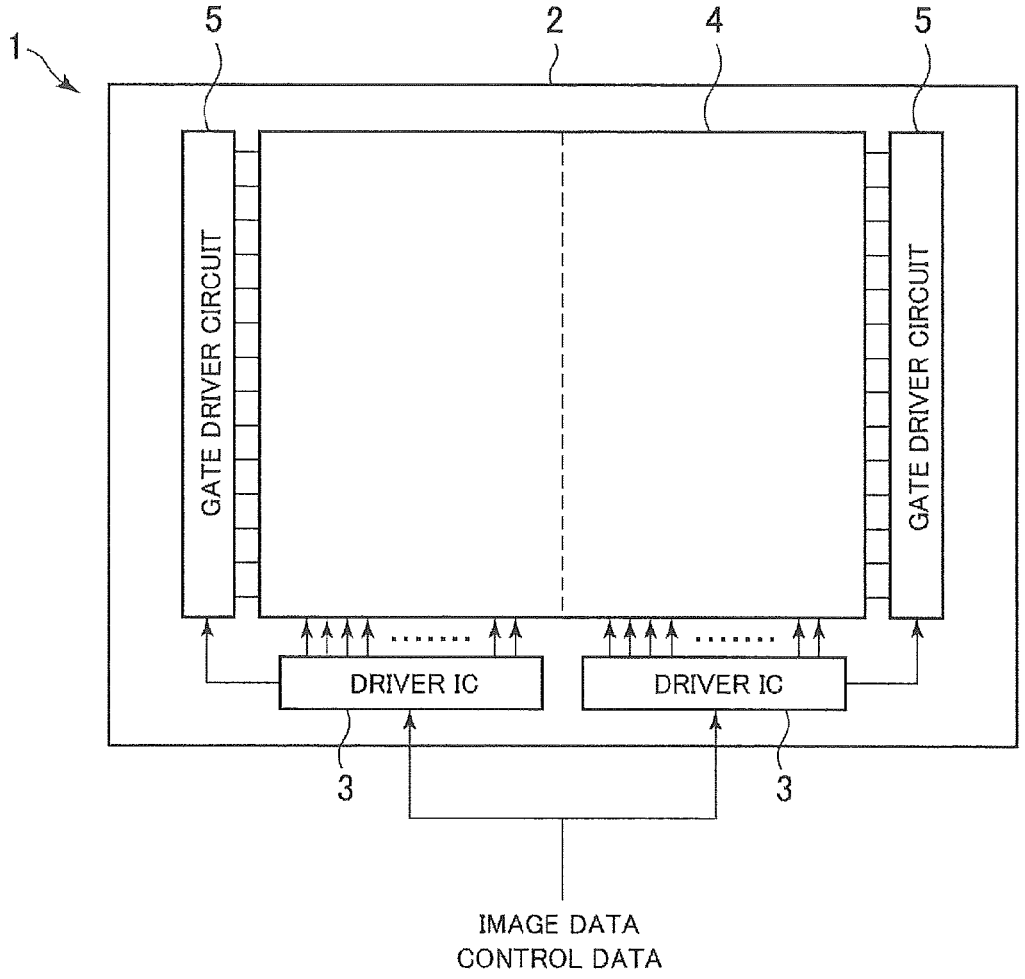
FIG. 1 is a block diagram illustrating an exemplary configuration of a display device in a first embodiment of the present invention.

FIG. 1 is the block diagram illustrating an exemplary configuration of a display device 1 in a first embodiment of the present invention. The display device 1, which is configured as a liquid crystal display device, includes a liquid crystal display panel 2 and a plurality of driver ICs 3. The liquid crystal display panel 2 includes a display area 4 in which pixels, source lines (which may be also referred to as data lines or signal lines), gate lines (which may be also referred to as address lines or scan lines) are arranged, and gate driver circuits 5 which drive the gate lines arranged in the display area 4. In one embodiment, the gate driver circuits 5 may be formed on the glass substrate of the liquid crystal display panel 2 by using a COG (circuit-on-glass) technique. Each driver IC 3 drives the corresponding source lines in the display area 4 in response to image data and control data, which are received from an external device (for example, CPU (central processing unit)), and also generates control signals for controlling the gate driver circuits 5. It should be noted that the number of the driver ICs 3 is not limited to two, although FIG. 1 illustrates that the display device 1 includes two driver ICs 3.

Figure 2:
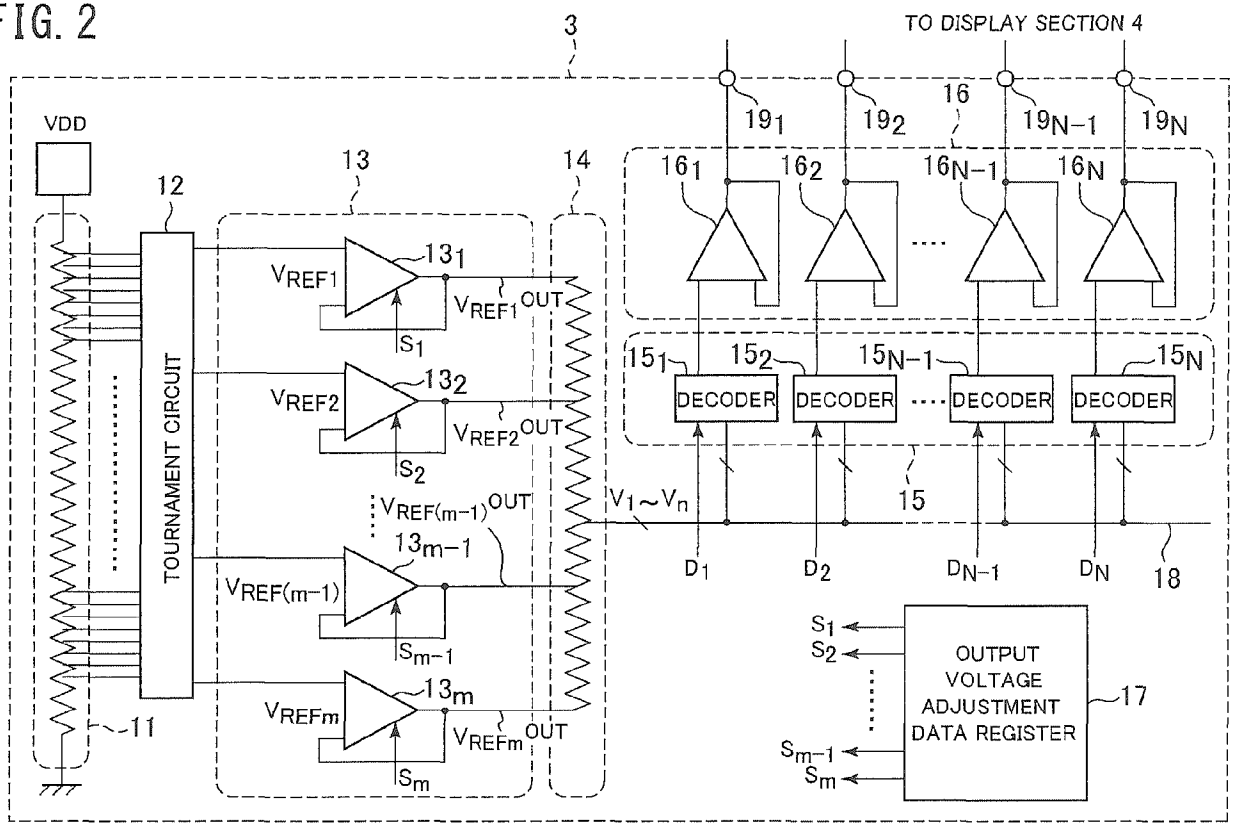
FIG. 2 is a circuit diagram illustrating an exemplary configuration of a driver IC in the first embodiment.

FIG. 2 is a block diagram illustrating an exemplary configuration of each driver IC 3. Each driver IC 3 includes a voltage dividing resistor 11, a tournament circuit 12, a grayscale amplifier circuit 13, a voltage dividing resistor 14, a decoder circuit 15, an output circuit 16 and an output voltage adjustment data register 17.

The voltage dividing resistor 11 and the tournament circuit 12 function as a grayscale reference voltage generator for supplying input grayscale reference voltages $V_{REF1}$ to $V_{REFm}$ to the grayscale amplifier circuit 13. In detail, the voltage dividing resistor 11 is connected between a power supply VDD and a ground terminal to generate a plurality of voltages, which are different from one another, by voltage dividing. The tournament circuit 12 selects m voltages from the plurality of voltages generated by the voltage dividing resistor 11 and supplies the selected m voltages as the input grayscale reference voltages $V_{REF1}$ to $V_{REFm}$ to the grayscale amplifier circuit 13.

The grayscale amplifier circuit 13 includes grayscale amplifiers $\mathbf{13}_1$ to $\mathbf{13}_m$. The grayscale amplifiers $\mathbf{13}_1$ to $\mathbf{13}_m$ generate output grayscale reference voltages $V_{FEF1}{}^{OUT}$ to $V_{REFm}{}^{OUT}$ from the input grayscale reference voltages $V_{REF1}$ to $V_{REFm}$, respectively. The grayscale amplifiers $\mathbf{13}_1$ to $\mathbf{13}_m$ are configured to control the output grayscale reference voltages $V_{REF1}{}^{OUT}$ to $V_{REFm}{}^{OUT}$ in response to control signals $S_1$ to $S_m$, respectively, which are supplied from the output voltage adjustment data register 17. In the driver IC 3 of this embodiment, the control of each output grayscale reference voltage $V_{REFi}{}^{OUT}$ is carried out by adjusting the offset voltage of the grayscale amplifier $\mathbf{13}_i$ in response to the control signal $S_i$. The configuration of each grayscale amplifier $\mathbf{13}_i$ will be described later in detail.

The voltage dividing resistor 14, which is connected to the outputs of the grayscale amplifiers $\mathbf{13}_1$ to $\mathbf{13}_m$, generates grayscale voltages $V_1$ to $V_n$ by using the output grayscale reference voltages $V_{REF1}{}^{OUT}$ to $V_{REFm}{}^{OUT}$ received from the grayscale amplifiers $\mathbf{13}_1$ to $\mathbf{13}_m$. In detail, the outputs of the grayscale amplifiers $\mathbf{13}_1$ to $\mathbf{13}_m$ are connected to different positions of the voltage dividing resistor 14, and n grayscale voltages lines 18 are connected to different positions. The grayscale voltages $V_1$ to $V_n$ are generated on the n grayscale voltages lines 18, respectively, by voltage dividing. The grayscale voltages lines 18 are connected to the decoder circuit 15.

The decoder circuit 15 includes decoders $\mathbf{15}_1$ to $\mathbf{15}_N$. The decoders $\mathbf{15}_1$ to $\mathbf{15}_N$ select the grayscale voltages $V_1$ to $V_n$ in response to the values of image data $D_1$ to $D_N$, respectively, and output the selected grayscale voltages to the output circuits 16. Here, the image data $D_1$ to $D_N$ are the data indicative of the graylevels of the respective pixels to be driven. The grayscale voltage selected by each of the decoders $\mathbf{15}_1$ to $\mathbf{15}_N$ is supplied to the output circuit 16.

The output circuit 16 includes output amplifiers $\mathbf{16}_1$ to $\mathbf{16}_N$. The output amplifiers $\mathbf{16}_1$ to $\mathbf{16}_N$ output the drive voltages corresponding to the grayscale voltages received from the decoders $\mathbf{15}_1$ to $\mathbf{15}_N$, to source outputs $\mathbf{19}_1$ to $\mathbf{19}_N$, respectively. The drive voltages outputted from the output amplifiers $16_1$ to $16_N$ basically have the same voltage levels as the corresponding grayscale voltages. Here, the source outputs $19_1$ to $19_N$ are output terminals connected to the source lines of the display area 4. The pixels in the display area 4 are driven by the drive voltages outputted from the output amplifiers $16_1$ to $16_N$.

The output voltage adjustment data register 17 is a storage unit for storing adjustment data in a non-volatile manner to control the output grayscale reference voltages $V_{REF1}^{OUT}$ to $V_{REFm}^{OUT}$ outputted from the grayscale amplifiers $13_1$ to $13_m$. The output voltage adjustment data register 17 outputs the control signals $S_1$ to $S_m$ corresponding to the values of the adjustment data and supplies the control signals $S_1$ to $S_m$ to the grayscale amplifiers $13_1$ to $13_m$, respectively. It should be noted that the output voltage adjustment data register 17 is integrated in a chip which incorporates the voltage dividing resistor 11, the tournament circuit 12, the grayscale amplifier 13, the voltage dividing resistor 14, the decoder circuit 15 and the output circuit 16 in this embodiment; in other words, the voltage dividing resistor 11, the tournament circuit 12, the grayscale amplifier 13, the voltage dividing resistor 14, the decoder circuit 15 and the output circuit 16 and the output voltage adjustment data register 17 are monolithically integrated.

The display device 1 of this embodiment is configured so that the output grayscale reference voltages $V_{REF1}^{OUT}$ to $V_{REFm}^{OUT}$ outputted from the grayscale amplifiers $13_1$ to $13_m$ can be adjusted in response to the control signals $S_1$ to Sm outputted from the output voltage adjustment data register 17. The settings of the control signals $S_1$ to $S_m$ are achieved by setting the adjustment data stored in a non-volatile manner in the output voltage adjustment data register 17 by using a proper means. This configuration allows reducing the variations in the output grayscale reference voltages $V_{REF1}^{OUT}$ to $V_{REFm}^{OUT}$ between the driver ICs 3.

The output grayscale reference voltages $V_{REF1}^{OUT}$ to $V_{REFm}^{OUT}$ may be adjusted, for example, in a shipment test of the driver ICs 3. The adjustments of the output grayscale reference voltages $V_{REF1}^{OUT}$ to $V_{REFm}^{OUT}$ in the shipment test may be carried out, for example, in the following procedure. First, the output voltages of the grayscale amplifiers $13_1$ to $13_m$ are measured. In one embodiment, the output voltages of the grayscale amplifiers $13_1$ to $13_m$ may be measured by measuring the voltages on ones of the grayscale voltages lines 18, to which the output voltages of the grayscale amplifiers $13_1$ to $13_m$ (the output grayscale reference voltages $V_{REF1}^{OUT}$ to $V_{REFm}^{OUT}$) are directly outputted as they are. This is followed by setting the adjustment data stored in the output voltage adjustment data register 17 so that the measured output grayscale reference voltages $V_{REF1}^{OUT}$ to $V_{REFm}^{OUT}$ are adjusted to desired voltage levels. The output grayscale reference voltages $V_{REF1}^{OUT}$ to $V_{REFm}^{OUT}$ can be adjusted to the desired voltage levels by appropriately setting the adjustment data stored in the output voltage adjustment data register 17 for all of the grayscale amplifiers $13_1$ to $13_m$.

It should be noted that the output grayscale reference voltages $V_{REF1}^{OUT}$ to $V_{REFm}^{OUT}$ namely, the offset voltages of the grayscale amplifiers $13_1$ to $13_m$ are set in response to the adjustment data stored in a non-volatile manner in the output voltage adjustment data register 17 and the settings of the output grayscale reference voltages $V_{REF1}^{OUT}$ to $V_{REFm}^{OUT}$ are unchanged in the normal operation of the display device 1. The settings of the offset voltages of the grayscale amplifiers $13_1$ to $13_m$ are independent from the display timing. For example, the controls the offset voltages of the grayscale amplifiers $13_1$ to $13_m$ are asynchronous with the horizontal synchronous signal and the vertical synchronous signal; in the normal operation of the display device 1, common adjustment data are used in all of horizontal synchronization periods and vertical synchronization periods. The display device 1 of this embodiment is configured so that the respective driver ICs 3 can individually control the offset voltages of the grayscale amplifiers $13_1$ to $13_m$, namely, the output grayscale reference voltages $V_{REF1}^{OUT}$ to $V_{REFm}^{OUT}$ under an assumption that the properties of the grayscale amplifiers $13_1$ to $13_m$ may differ from one another between the driver ICs 3.

As described above, in this embodiment, the output voltages of the grayscale amplifiers $13_1$ to $13_m$ in the grayscale amplifier 13 are controlled in response to the control signals $S_1$ to $S_m$, respectively, which are generated in response to the adjustment data stored in a non-volatile manner in the output voltage adjustment data register 17. Such configuration of the driver ICs 3 allows reducing the variations in the output grayscale reference voltages $V_{REF1}^{OUT}$ to $V_{REFm}^{OUT}$ between the driver ICs 3 by suitably setting the adjustment data.

Second Embodiment

Figure 3:
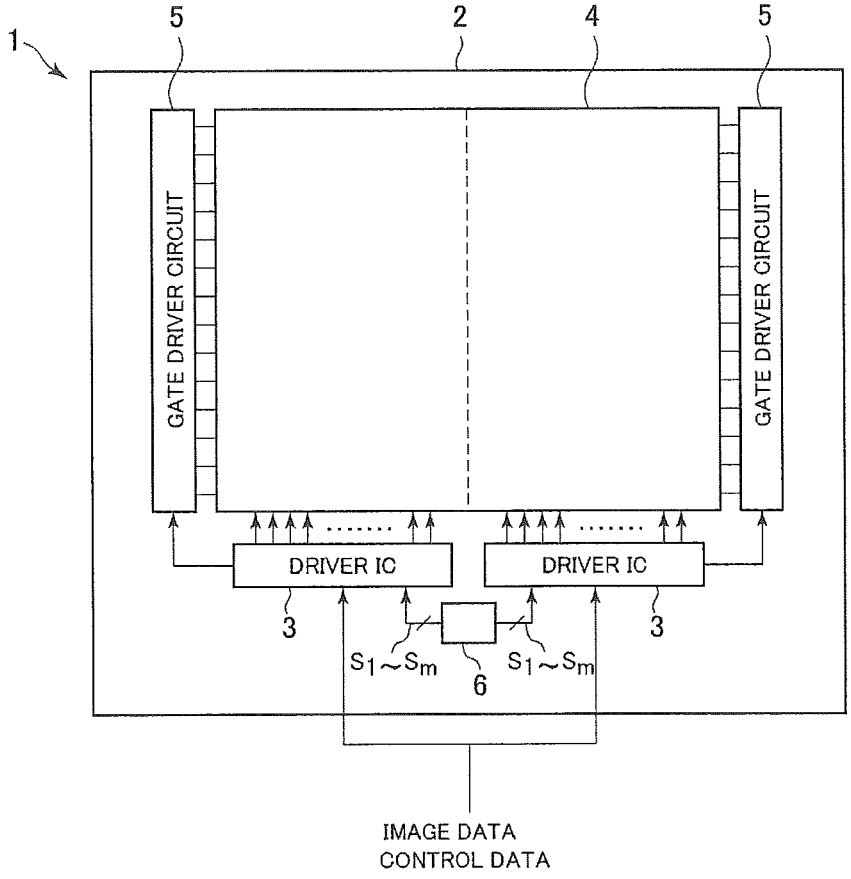
FIG. 3 is a block diagram illustrating an exemplary configuration of a display device in a second embodiment of the present invention.
Figure 4:
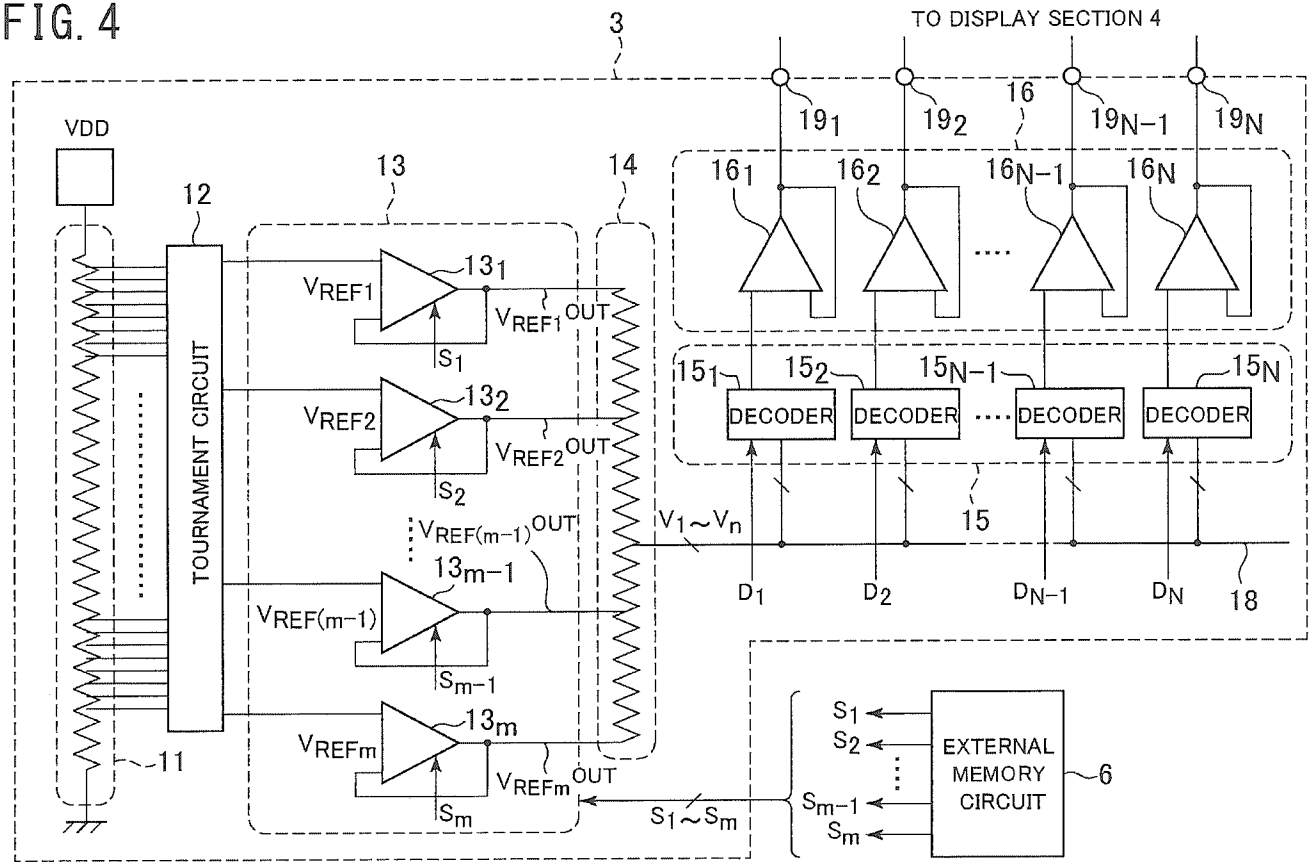
FIG. 4 is a circuit diagram illustrating an exemplary configuration of a driver IC in the second embodiment.

FIG. 3 is a block diagram illustrating an exemplary configuration of the display device 1 in a second embodiment of the present invention, and FIG. 4 is a block diagram illustrating an exemplary configuration of each driver IC 3 in the second embodiment.

In the second embodiment, as shown in FIG. 3, an external storage device 6, which is integrated in an IC chip, is provided separately from the driver ICs 3. It should be noted that, as shown in FIG. 4, the output voltage adjustment data register 17 is not integrated in the driver ICs 3. The external storage device 6 stores adjustment data for each driver IC 3 in a non-volatile manner and supplies control signals $S_1$ to $S_m$ to each driver IC 3 in response to the adjustment data. Each driver IC 3 has external input terminals for externally receiving the control signals $S_1$ to $S_m$ and receives the control signals $S_1$ to $S_m$ from the external storage device 6 on the external input terminals. The grayscale amplifiers $13_1$ to $13_m$ in each driver IC 3 are configured to control the output grayscale reference voltages $V_{REF1}^{OUT}$ to $V_{REFm}^{OUT}$ in response to the control signals $S_1$ to $S_m$ supplied from the external storage device 6.

The above-described display device 1 and the driver ICs 3 in the second embodiment can also reduce the variations in the output grayscale reference voltages $V_{REF1}^{OUT}$ to $V_{REFm}^{OUT}$ between the driver ICs 3 by suitably setting the adjustment data stored in the external storage device 6.

In the following, a description is given of various examples of the grayscale amplifier $13_i$ used in the above-described embodiments (that is, the first and second embodiments). It should be noted that all of the grayscale amplifiers $13_i$ described below commonly have the function of adjusting the output voltage in response to the control signal $S_i$.

Example 1

Figure 5A:
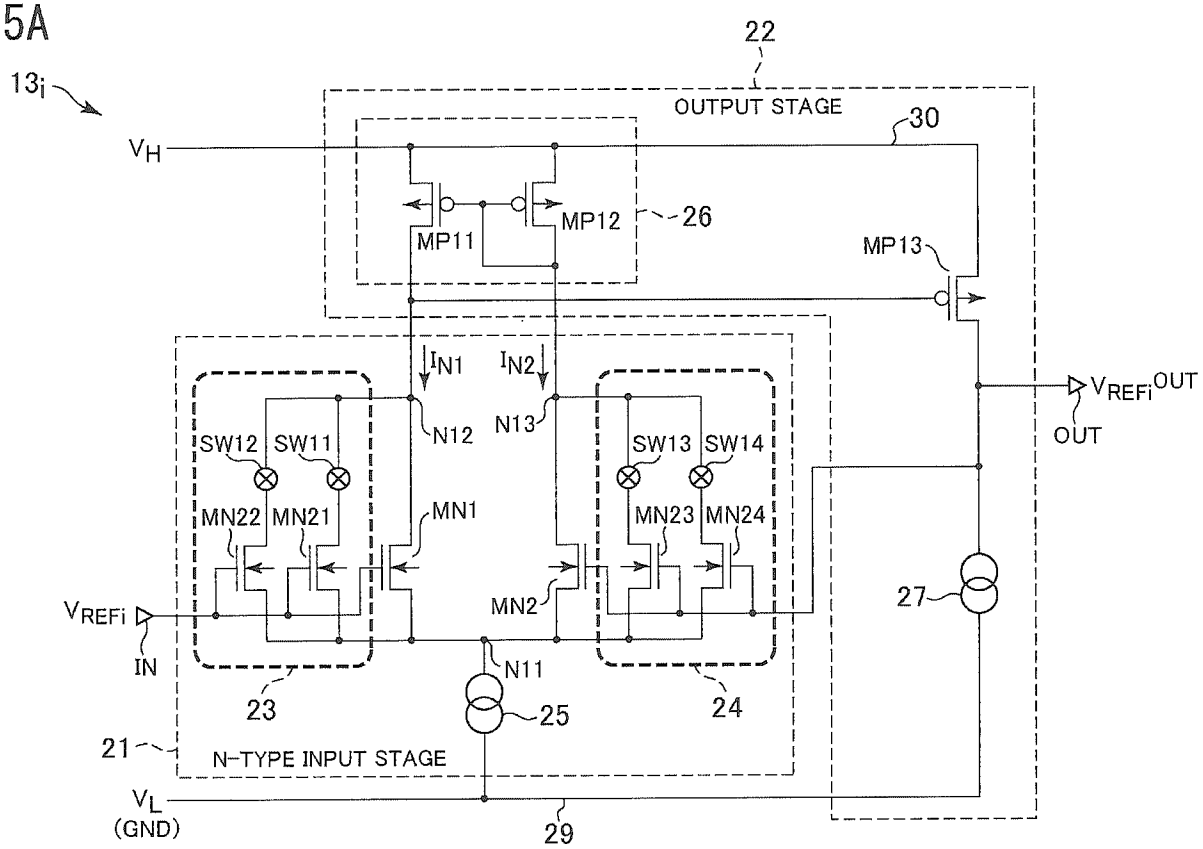
FIG. 5A is a circuit diagram illustrating the configuration of a grayscale amplifier in Example 1.

FIG. 5A is the circuit diagram illustrating an exemplary configuration of a first example of the grayscale amplifier $13_i$, which is referred to as "Example 1", hereinafter. The grayscale amplifier $13_i$ in Example 1 is configured as a voltage follower which includes an N-type input stage 21 and an output stage 22. The N-type input stage 21 includes NMOS transistors MN1 and MN2, output voltage adjustment circuits 23 and 24 and a constant current source 25.

The NMOS transistors MN1 and MN2 form a differential transistor pair, having sources commonly connected to a node N11. The gate of the NMOS transistor MN1 is connected to an input node IN to which the input grayscale reference voltage $V_{REFi}$ is inputted, and the gate of the NMOS transistor MN2 is connected to an output node OUT from which the output grayscale reference voltage $V_{REFi}^{OUT}$ is outputted. The drains of the NMOS transistors MN1 and MN2 are connected to nodes N12 and N13, respectively.

The output voltage adjustment circuits 23 and 24 are a pair of circuits used to adjust the offset voltage of the grayscale amplifier $\mathbf{13}_i$, namely, the output grayscale reference voltage $V_{REFi}^{OUT}$. The output voltage adjustment circuit 23 includes switches SW11 and SW12 and NMOS transistors MN21 and MN22 which have gates commonly connected to the input node IN. The switch SW11 and the NMOS transistor MN21 are connected in series between the node N11 and the node N12 to form a first adjustment leg. The switch SW12 and the NMOS transistor MN22 are connected in series between the node N11 and the node N12 to form a second adjustment leg. The first and second adjustment legs, which are connected in parallel to each other, have the function of controlling a current $I_{N1}$ flowing through the N-type input stage 21, by on/off controls of the switches SW11 and SW12. Here, the current $I_{N1}$ is the sum current of the currents flowing through the NMOS transistors MN1, MN21 and MN22. The gate widths of the NMOS transistors MN21 and MN22 are designed to be smaller than the gate width of the NMOS transistor MN1, and the current $I_{N1}$ is mainly determined by the current flowing through the NMOS transistor MN1. The NMOS transistors MN21 and MN22 are used to finely adjust the current $I_{N1}$.

Similarly, the output voltage adjustment circuit 24 includes switches SW13 and SW14 and NMOS transistors MN23 and MN24 which have gates commonly connected to the output node OUT. The switch SW13 and the NMOS transistor MN23 are connected in series between the node N11 and the node N13 to form a third adjustment leg. The switch SW14 and the NMOS transistor MN24 are connected in series between the node N11 and the node N13 to form a fourth adjustment leg. The third and fourth adjustment legs, which are connected in parallel to each other, have the function of controlling a current $I_{N2}$ flowing through the N-type input stage 21 by on/off controls of the switches SW13 and SW14. Here, the current $I_{N2}$ is the sum current of the currents flowing through the NMOS transistors MN2, MN23 and MN24. The gate widths of the NMOS transistors MN23 and MN24 are designed to be smaller than the gate width of the NMOS transistor MN2, and the current $I_{N2}$ is mainly determined by a current flowing through the NMOS transistor MN2. The NMOS transistors MN23 and MN24 are used to finely adjust the current $I_{N2}$.

The switches SW11 to SW14 are each set to the on-state or off-state in response to the control signal $S_i$, which is supplied to the grayscale amplifier $\mathbf{13}_i$. As described later, the grayscale amplifier $\mathbf{13}_i$ in FIG. 5A is adapted to control the offset voltage, namely, the output grayscale reference voltage $V_{REF1}^{OUT}$ by switching the switches SW11 to SW14 in response to the control signal $S_i$.

The constant current source 25 is connected between the node N11 and a low-side power line 29 and draws a constant current from the node N11. The sum of the currents $I_{N1}$ and $I_{N2}$ is kept constant by the operation of the constant current source 25. Here, the low-side power line 29 is a power line having a potential level of $V_L$; the low-side power line 29 may have the ground potential.

The output stage 22 is a circuitry configured to output the output grayscale reference voltage $V_{REFi}^{OUT}$ from the output node OUT in response to the currents $I_{N1}$ and $I_{N2}$ flowing through the N-type input stage 21; the output stage 22 includes a current mirror 26, a PMOS transistor MP13 and a constant current source 27.

The current mirror 26 is used as a load of the N-type input stage 21 and includes PMOS transistors MP11 and MP12. The PMOS transistor MP11 has a drain connected to the node N12 and a source connected to a high-side power line 30. The PMOS transistor MP12 has a drain connected to the node N13 and a source connected to the high-side power line 30. The gates of the PMOS transistors MP11 and MP12 are commonly connected to each other, and the commonly-connected gates are connected to the drain of one of the PMOS transistors MP11 and MP12 (in this example, connected to the drain of the PMOS transistor MP12). Here, the high-side power line 30 is a power line having a potential level of $V_H$ higher than the potential level $V_L$; the high-side power line 30 may have the power supply level.

The PMOS transistor MP13 operates as an output transistor which drives the output node OUT. The PMOS transistor MP13 has a source connected to the high-side power line 30, a gate connected to the node N12 and a drain connected to the output node OUT. The constant current source 27 draws a constant current from the drain of the PMOS transistor MP13.

If the NMOS transistors MN1 and MN2 have the same properties and the other transistors have ideal properties, the above-configured grayscale amplifier $\mathbf{13}_i$ operates so that the input grayscale reference voltage $V_{REFi}$ is outputted as it is as the output grayscale reference voltage $V_{REF1}^{OUT}$, when the switches SW11 to SW14 are set to the off-state. Nevertheless, MOS transistors integrated in the driver IC 3 exhibit variations resulting from the manufacturing process, and the variations are different between the driver ICs 3 depending on the grayscale amplifiers. Accordingly, the display device 1 which incorporates multiple driver ICs 3 exhibits variations in the grayscale voltages between the driver ICs 3.

The grayscale amplifier $\mathbf{13}_i$ configured as illustrated in FIG. 5A can adjust the offset voltage of the grayscale amplifier $\mathbf{13}_i$, namely, the output grayscale reference voltage $V_{REFi}^{OUT}$ by switching the switches SW11 to SW14 of the output voltage adjustment circuits 23 and 24 in response to the control signal $S_i$. In detail, the currents $I_{N1}$ and $I_{N2}$ flowing through the N-type input stage 21 can be finely adjusted by switching the switches SW11 to SW14 in response the control signal $S_i$. The currents $I_{N1}$ and $I_{N2}$ flowing through the N-type input stage 21 have influence on the offset voltage of the grayscale amplifier $\mathbf{13}_i$. When the currents $I_{N1}$ and $I_{N2}$ are different, for example, the grayscale amplifier $\mathbf{13}_i$ exhibits an offset voltage. This implies that, it is possible to adjust the offset voltage of the grayscale amplifier $\mathbf{13}_i$, namely, the output grayscale reference voltage $V_{REFi}^{OUT}$ by suitably switching the switches SW11 to SW14 in response to the control signal $S_i$. Since the grayscale voltages $V_i$ to $V_n$ depend on the output grayscale reference voltages $V_{REF1}^{OUT}$ to $V_{REFi}^{OUT}$, adjusting the output grayscale reference voltage $V_{REFi}^{OUT}$ of each grayscale amplifier $\mathbf{13}_i$ in each driver IC 3 allows reducing the variations in the grayscale voltages between the driver ICs 3 in the display device 1.

The output grayscale reference voltage $V_{REFi}^{OUT}$ of the grayscale amplifier $\mathbf{13}_i$ may be adjusted in the following procedure. In the shipment test of the driver IC 3, the output grayscale reference voltage $V_{REFi}^{OUT}$ is measured on the line to which the output grayscale reference voltage $V_{REFi}^{OUT}$ of the grayscale amplifier 13$_i$ is directly outputted, out of the grayscale voltages lines 18. The on/off states of the switches SW11 to SW14 of the output voltage adjustment circuits 23 and 24 are set so that the measured output grayscale reference voltage $V_{REFi}^{OUT}$ is adjusted to a desired voltage level. In other words, the set value of the control signal $S_i$ for controlling the switches SW11 to SW14 is determined so that the measured output grayscale reference voltage $V_{REFi}^{OUT}$ is adjusted to a desired voltage level. This procedure is performed for all the grayscale amplifiers 13$_i$. Then, the set value of the control signal $S_i$ is stored, in a non-volatile manner as the adjustment data into the output voltage adjustment data register 17 in each driver IC 3 (in the first embodiment) or the external storage device 6 (in the second embodiment).

While the display device 1 performs a normal operation, the switches SW11 to SW14 are placed in the on-state or off-state in response to the control signal $S_i$ which is generated in response to the adjustment data stored in a non-volatile manner in the output voltage adjustment data register 17 in each driver IC 3 or in the external storage device 6, to thereby set the output grayscale reference voltage $V_{REFi}^{OUT}$ of the grayscale amplifier 13$_i$ to a desired voltage level. It is possible to reduce the difference in the grayscale voltages between the driver ICs 3 by carrying out the foregoing operation in each driver IC 3.

It should be noted that the number of the adjustment legs (each including a switch and an NMOS transistor connected in series) may be modified in the output voltage adjustment circuit 23. In principle, it is possible to attain the function of adjusting the output grayscale reference voltage $V_{REF}^{OUT}$ if the output voltage adjustment circuit 23 includes at least one adjustment leg. Similarly, the number of the adjustment legs each including a switch and an NMOS transistor connected in series may be modified also in the output voltage adjustment circuit 24. In principle, it is possible to attain the function of adjusting the output grayscale reference voltage $V_{REFi}^{OUT}$, if the output voltage adjustment circuit 24 includes at least one switch and one MOS transistor.

Example 2

Figure 5B:
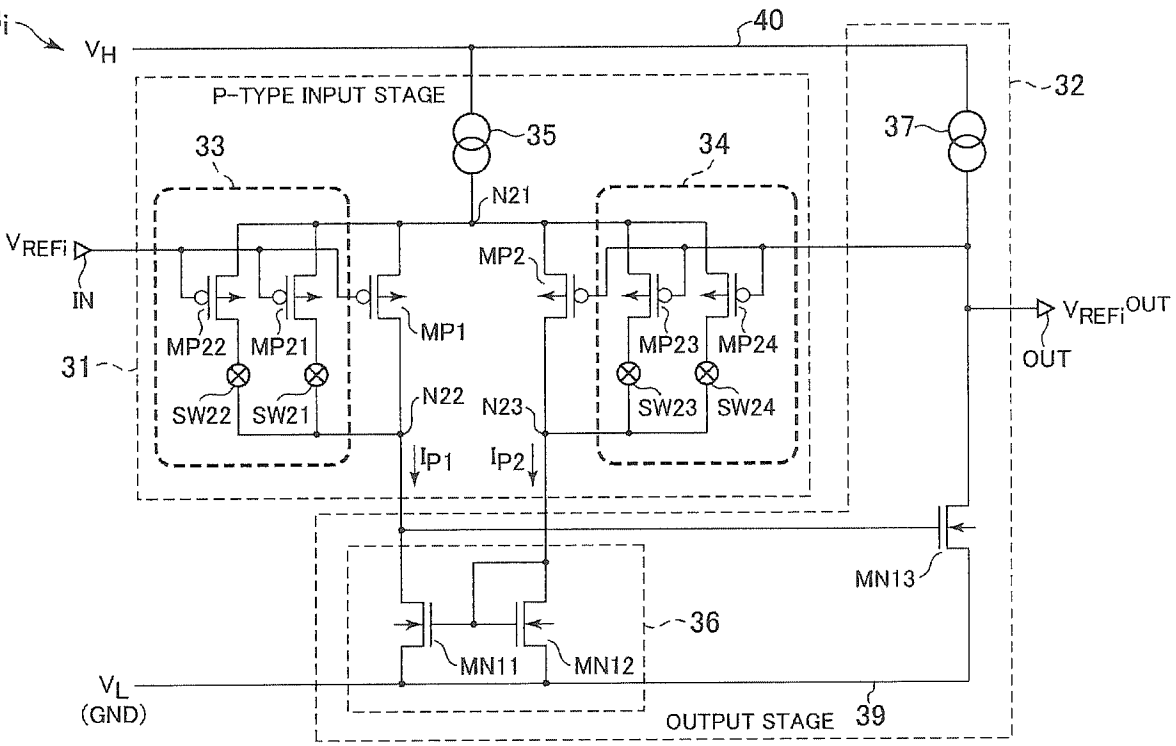
FIG. 5B is a circuit diagram illustrating the configuration of a grayscale amplifier in Example 2.

FIG. 5B is a circuit diagram illustrating an exemplary configuration of a second example the grayscale amplifier 13$_i$, which is referred to as Example 2, hereinafter. Schematically, the circuit configuration of the grayscale amplifier 13$_i$ in Example 2 corresponds to the circuit structure in which the conductivity types (the P-type or the N-type) of the respective MOS transistors are reversed in the circuit configuration of Example 1.

In detail, the grayscale amplifier 13; in Example 2 is configured as a voltage follower which includes a P-type input stage 31 and an output stage 32. The P-type input stage 31 includes PMOS transistors MP1 and MP2, output voltage adjustment circuits 33 and 34 and a constant current source 35.

The PMOS transistors MP1 and MP2, which form a differential transistor pair, have sources are commonly connected to a node N21. The PMOS transistor MP1 has a gate connected to the input node IN to which the input grayscale reference voltage $V_{REFi}$ is inputted, and the PMOS transistor MP2 has a gate connected to the output node OUT from which the output grayscale reference voltage $V_{REFi}^{OUT}$ is outputted. The drains of the PMOS transistors MP1 and MP2 are connected to nodes N22 and N23, respectively.

The output voltage adjustment circuits 33 and 34 are a pair of circuits used to adjust the offset voltage of the grayscale amplifier 13$_i$, namely, the output grayscale reference voltage $V_{REFi}^{OUT}$. The output voltage adjustment circuit 33 includes switches SW21 and SW22 and PMOS transistors MP21 and MP22 which have gates commonly connected to the input node IN. The switch SW21 and the PMOS transistor MP21 are connected in series between the node N21 and the node N22 to form a first adjustment leg. The switch SW22 and the PMOS transistor MP22 are connected in series between the node N21 and the node N22 to form a second adjustment leg. The first and second adjustment legs, which are connected in parallel to each other, have the function of controlling a current $I_{P1}$ flowing through the P-type input stage 31 by on/off controls of the switches SW21 and SW22. Here, the current $I_{P1}$ is the sum current of the currents flowing through the PMOS transistors MP1, MP21 and MP22. The gate widths of the PMOS transistors MP21 and MP22 are designed to be smaller than the gate width of the PMOS transistor MP1, and the current $I_{P1}$ is mainly determined by a current flowing through the PMOS transistor MP1. The PMOS transistors MP21 and MP22 are used to finely adjust the current $I_{P1}$.

Similarly, the output voltage adjustment circuit 34 includes switches SW23 and SW24 and PMOS transistors MP23 and MP24 which have gates commonly connected to the output node OUT. The switch SW23 and the PMOS transistor MP23 are connected in series between the node N21 and the node N23 to form a third adjustment leg. The switch SW24 and the PMOS transistor MP24 are connected in series between the node N21 and the node N23 to form a fourth adjustment leg. The third and fourth adjustment legs, which are connected in parallel to each other, have the function of controlling a current $I_{P2}$ flowing through the P-type input stage 31 by on/off controls of the switches SW23 and SW24. Here, the current $I_{P2}$ is the sum current of the currents flowing through the PMOS transistors MP2, MP23 and MP24. The gate widths of the PMOS transistors MP23 and MP24 are designed to be smaller than the gate width of the PMOS transistor MP2, and the current $I_{P2}$ is mainly determined by a current flowing through the PMOS transistor MP2. The PMOS transistors MP23 and MP24 are used to finely adjust the current $I_{P2}$.

The switches SW21 to SW24 are each set to the on-state or off-state in response to the control signal $S_i$, which is supplied to the grayscale amplifier 13$_i$. The grayscale amplifier 13$_i$ in FIG. 5B is adapted to control the offset voltage, namely, the output grayscale reference voltage $V_{REFi}^{OUT}$ by switching the switches SW11 to SW14 in response to the control signal $S_i$.

The constant current source 35 is connected between the node N21 and a high-side power line 40 and supplies a constant current to the node N21. The sum of the currents $I_{P1}$ and $I_{P2}$ is kept constant by the operation of the constant current source 35. Here, the high-side power line 40 is a power line having a potential level of $V_H$.

The output stage 32 is a circuitry configured to output the output grayscale reference voltage $V_{REFi}^{OUT}$ from the output node OUT in response to the currents $I_{P1}$ and $I_{P2}$ flowing through the P-type input stage 31; the output stage 32 includes a current mirror 36, an NMOS transistor MN13 and a constant current source 37.

The current mirror 36 is used as a load of the P-type input stage 31 and includes NMOS transistors MN11 and MN12. The NMOS transistor MN11 has a drain connected to the node N22 and a source connected to a low-side power line 39. The NMOS transistor MN12 has a drain connected to the node N23 and a source connected to the low-side power line 39. The gates of the NMOS transistors MN11 and MN12 are commonly connected to each other, and the commonly-connected gates are connected to the drain of one of the NMOS transistors MN11 and MN12 (in this example, connected to the drain of the NMOS transistor MN12). Here, the low-side power line 39 is a power line having the potential level $V_L$.

The NMOS transistor MN13 operates as an output transistor which drives the output node OUT. The NMOS transistor MN13 has a source connected to the low-side power line 39, a gate connected to the node N22 and a drain connected to the output node OUT. The constant current source 37 supplies a constant current to the drain of the NMOS transistor MN13.

The grayscale amplifier $13_i$ configured as illustrated in FIG. 5B also can adjust the offset voltage of the grayscale amplifier $13_i$, namely, the output grayscale reference voltage $V_{REFi}^{OUT}$ by switching the switches SW21 to SW24 of the output voltage adjustment circuits 33 and 34 in response to the control signal $S_i$. It is possible to reduce the variations in the grayscale voltages between the driver ICs 3 in the display device 1 by storing the set value of the control signal $S_i$ for controlling the switches SW21 to SW24 in a non-volatile manner as the adjustment data in the output voltage adjustment data register 17 in each driver IC 3 (in the first embodiment) or the external storage device 6 (in the second embodiment) to adjust the output grayscale reference voltage $V_{REFi}^{OUT}$ of each grayscale amplifier $13_i$ in each driver IC 3.

It should be noted that the number of the adjustment legs (each including a switch and a PMOS transistor connected in series) may be modified in the output voltage adjustment circuits 33 and 34. In principle, it is possible to attain the function of adjusting the output grayscale reference voltage $V_{REFi}^{OUT}$ if each of the output voltage adjustment circuits 33 and 34 includes at least one adjustment leg including one switch and one PMOS transistor.

Example 3

Figure 5C:
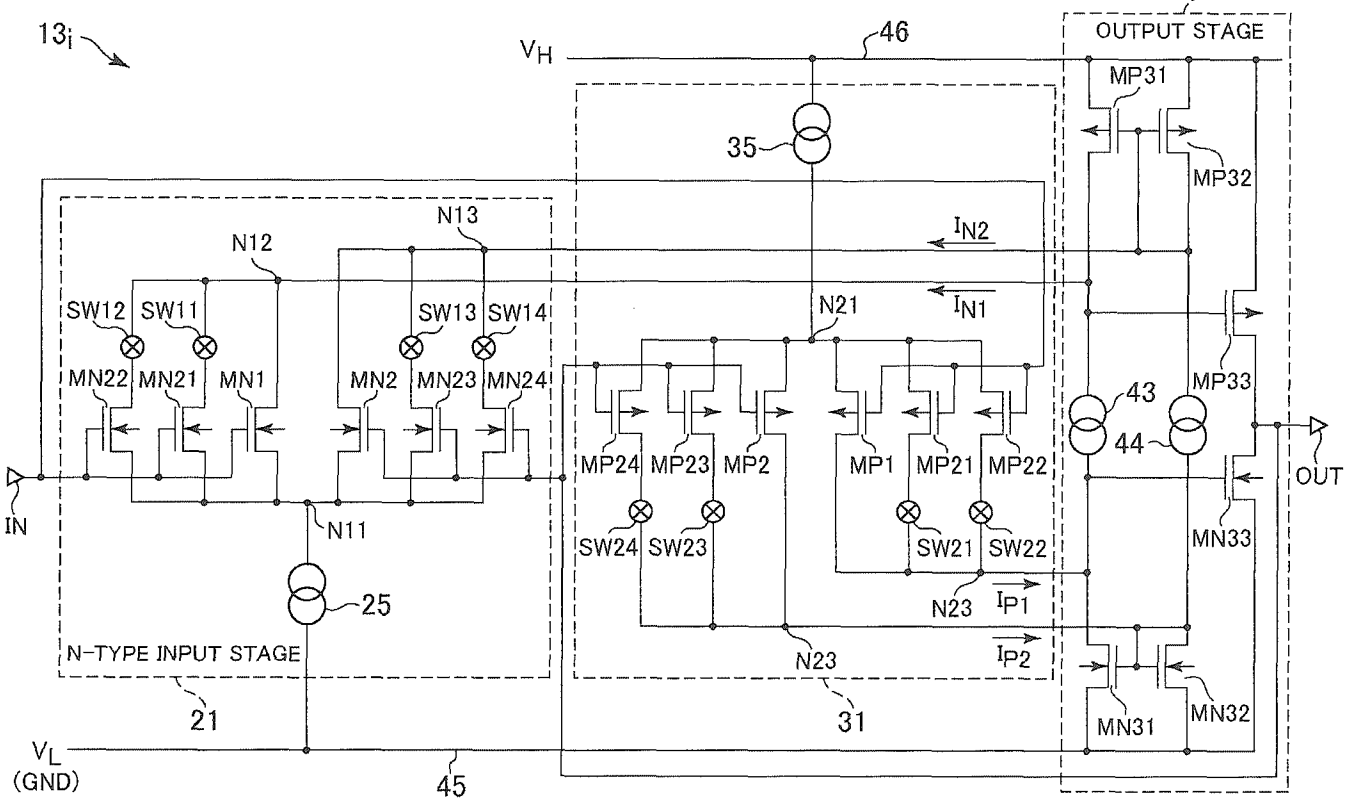
FIG. 5C is a circuit diagram illustrating the configuration of a grayscale amplifier in Example 3.

FIG. 5C is a block diagram illustrating an exemplary configuration of a third embodiment of the grayscale amplifier $13_i$, which is referred to as Example 3, hereinafter. The grayscale amplifier $13_i$ in Example 3 is configured as a rail-to-rail amplifier which includes both of an N-type input stage 21 and a P-type input stage 31. The output stage 42 which outputs the output grayscale reference voltage $V_{REFi}^{OUT}$ in response to the currents $I_{N1}$ and $I_{N2}$ flowing through the N-type input stage 21 and the currents $I_{P1}$ and $I_{P2}$ flowing through the P-type input stage 31 is connected to the N-type input stage 21 and the P-type input stage 31. The configuration of the N-type input stage 21 of the grayscale amplifier 13, in Example 3 is identical to that of the grayscale amplifier 13, in Example 1, and the configuration of the P-type input stage 31 of the grayscale amplifier 13, in Example 3 is identical to that of the grayscale amplifier $13_i$ in Example 2.

The output stage 42 includes PMOS transistors MP31 to MP33, NMOS transistors MN31 to MN33 and constant current sources 43 and 44.

The PMOS transistors MP31 and MP32 form a current mirror. In detail, the sources of the PMOS transistors MP31 and MP32 are commonly connected to a high-side power line 46, and the gates of the PMOS transistors MP31 and MP32 are commonly connected to the drain of the PMOS transistor MP32. The drains of the PMOS transistors MP31 and MP32 are connected to the constant current sources 43 and 44, respectively.

The NMOS transistors MN31 and MN32 form another current mirror. In detail, the sources of the NMOS transistors MN31 and MN32 are commonly connected to a low-side power line 45, and the gates of the NMOS transistors MN31 and MN32 are commonly connected to the drain of the NMOS transistor MN32. The drains of the NMOS transistors MN31 and MN32 are connected to the constant current sources 43 and 44, respectively.

The constant current source 43 generates a constant current which flows in the direction from the drain of the PMOS transistor MP31 to the drain of the NMOS transistor MN31, and the constant current source 44 generates a constant current which flows in the direction from the drain of the PMOS transistor MP32 to the drain of the NMOS transistor MN32.

The PMOS transistor MP33 and the NMOS transistor MN33 are used as output transistors which drive the output node OUT. The PMOS transistor MP33 has a source connected to the high-side power line 46, a gate connected to the drain of the PMOS transistor MP31 and a drain connected to the output node OUT. The NMOS transistor MN15 has a source connected to the low-side power line 45, a gate connected to the drain of the NMOS transistor MN31 and a drain connected to the output node OUT.

The grayscale amplifier $13_i$ configured as illustrated in FIG. 5C also can adjust the offset voltage of the grayscale amplifier $13_i$, namely, the output grayscale reference voltage $V_{REFi}^{OUT}$ by switching the switches SW11 to SW14 and SW21 to SW24 of the output voltage adjustment circuits 23, 24, 33 and 34 in response to the control signal $S_i$.

It is possible to reduce the variations in the grayscale voltages between the driver ICs 3 in the display device 1 by storing the set value of the control signal $S_i$ for controlling the switches SW11 to SW14 and SW21 to SW24 in a non-volatile manner as the adjustment data in the output voltage adjustment data register 17 in each driver IC 3 (in the first embodiment) or the external storage device 6 (in the second embodiment) to adjust the output grayscale reference voltage $V_{REFi}^{OUT}$ of each grayscale amplifier $13_i$ in each driver IC 3.

It should be noted that the number of the adjustment legs (each including a switch and a MOS transistor connected in series) may be modified in the output voltage adjustment circuits 23, 24 33 and 34.

Example 4

Figure 6A:
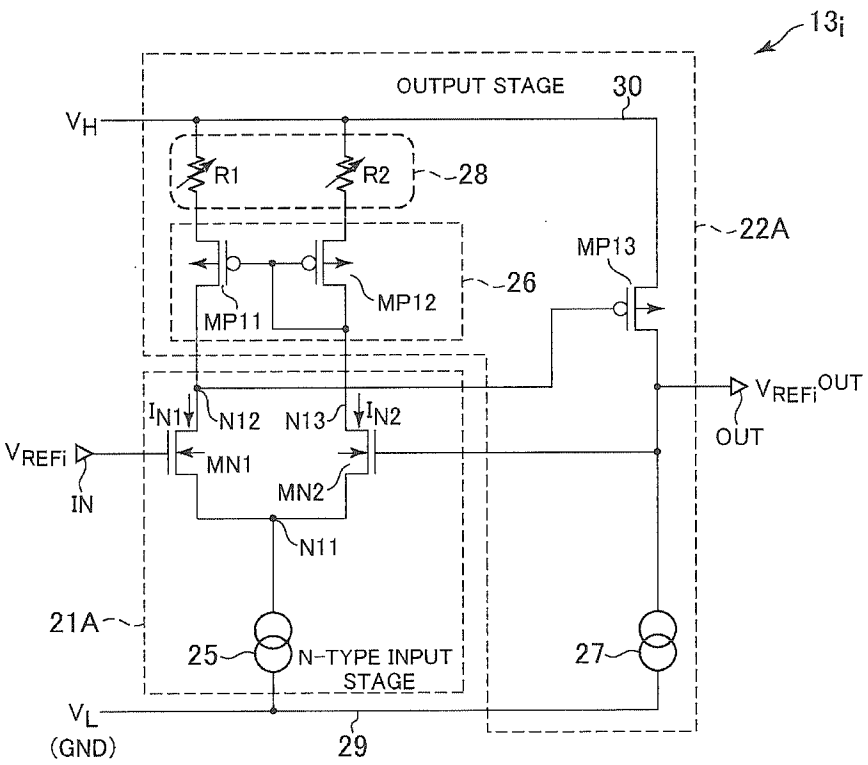
FIG. 6A is a circuit diagram illustrating the configuration of a grayscale amplifier in Example 4.

FIG. 6A is a circuit diagram illustrating a fourth example of the grayscale amplifier $13_i$, referred to as Example 4, hereinafter. In Example 4, the grayscale amplifier $13_i$ is configured as a voltage follower including an N-type input stage 21A, and an output stage 22A. In the grayscale amplifier $13_i$ in Example 4, the currents $I_{N1}$ and $I_{N2}$ flowing through the N-type input stage 21A are adjusted with a variable resistive load 28 connected in series to the current mirror 26 in the output stage 22A to thereby adjust the output grayscale reference voltage $V_{REFi}^{OUT}$. It should be noted that the current mirror 26 and the variable resistive load 28 function as a load circuit of the N-type input stage 21A as a whole. The configurations of other portions of the output stage 22A remain unchanged from the output stage 22 in Example 1. In addition, the N-type input stage 21A used in Example 4 does not include the output voltage adjustment circuits 23 and 24, differently from the N-type input stage 21 in Example 1.

More specifically, the variable resistive load 28 includes variable resistors R1 and R2. The variable resistor R1 is connected between the source of the PMOS transistor MP11 and the high-side power line 30, and the current $I_{N1}$ flows through the variable resistor R1. On the other hand, the variable resistor R2 is connected between the source of the PMOS transistor MP12 and the high-side power line 30, and the current $I_{N2}$ flows through the variable resistor R2. In this example, the resistance values of the variable resistors R1 and R2 are controlled in response to the control signal $S_i$ to thereby adjust the offset voltage of the grayscale amplifier $\mathbf{13}_1$, namely, the output grayscale reference voltage $V_{REFi}^{OUT}$.

Figure 6B:
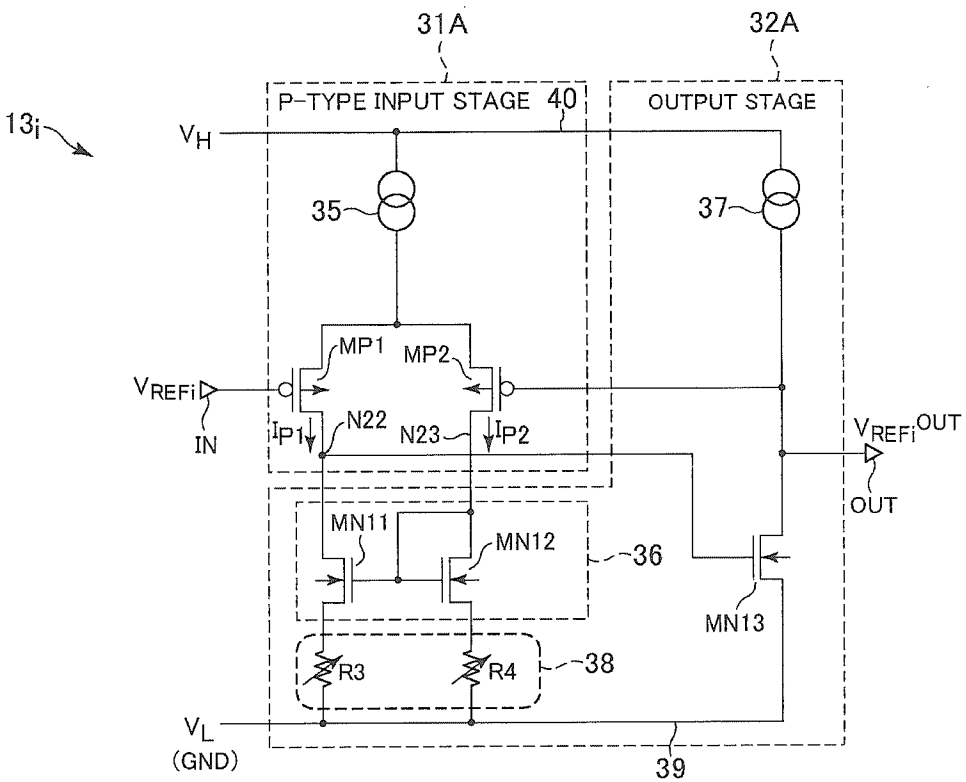
FIG. 6B is a circuit diagram illustrating the configuration of a grayscale amplifier in Example 5.
Figure 6C:
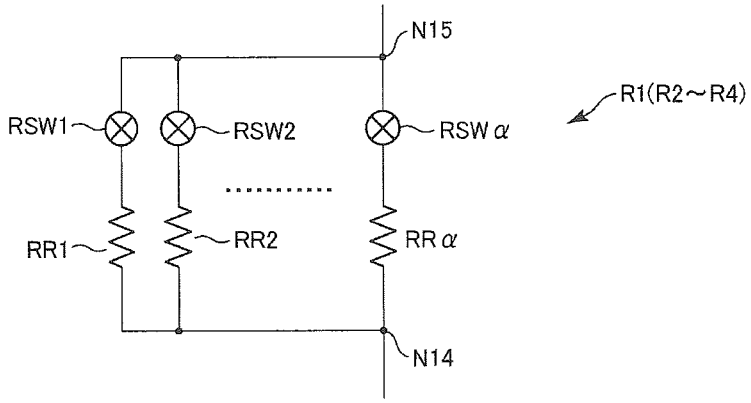
FIG. 6C is a circuit diagram illustrating an example of the configuration of a variable resistor used in the grayscale amplifiers in Examples 4 and 5.

FIG. 6C shows one example of the configuration of the variable resistor R1. In one example, each variable resistor R1 includes switches RSW1 to RSWα and resistive elements RR1 to RRα. The switch RSWj and the resistive element RRj are connected in series between a node N14 and a node N15. The node N14 is connected to the source of the PMOS transistor MP11, and the node N15 is connected to the high-side power line 30. The resistance value of the variable resistor R1 can be controlled by controlling the on/off states of the switches RSW1 to RSWα in response to the control signal $S_i$.

The variable resistor R2 may be configured in the same way as the variable resistor R1. In this case, the node N14 is connected to the source of the PMOS transistor MP12.

In the grayscale amplifier $\mathbf{13}_i$ configured as illustrated in FIG. 6A, the currents $I_{N1}$ and $I_{N2}$ flowing through the N-type input stage 21 can be finely adjusted by setting the resistance values of the variable resistors R1 and R2 in the variable resistive load 28 in response to the control signal $S_i$; this allows adjusting the offset voltage of the grayscale amplifier $\mathbf{13}_i$, namely, the output grayscale reference voltage $V_{REFi}^{OUT}$. It is possible to reduce the variations in the grayscale voltages between the driver ICs 3 in the display device 1 by adjusting the output grayscale reference voltage $V_{REFi}^{OUT}$ of each grayscale amplifier $\mathbf{13}_i$ in each driver IC 3, through storing the set value of the control signal $S_i$ for controlling the variable resistors R1 and R2 as the adjustment data in a non-volatile manner in the output voltage adjustment data register 17 in each driver IC 3 (in the first embodiment) or the external storage device 6 (the second embodiment).

It should be noted that the variable resistive load 28 may be provided between the nodes N12, N13 and the current mirror 26 instead of between the current mirror 26 and the high-side power line 30. In this case, the variable resistor R1 is connected between the node N12 and the drain of the PMOS transistor MP11, and the variable resistor R2 is connected between the node N13 and the drain of the PMOS transistor MP12.

Example 5

FIG. 6B is a circuit diagram illustrating a fifth example of the grayscale amplifier $\mathbf{13}_i$, referred to as Example 5, hereinafter. In Example 5, the grayscale amplifier $\mathbf{13}_i$ is configured as a voltage follower including a P-type input stage 31A, and an output stage 32A. In the grayscale amplifier $\mathbf{13}_i$ in Example 5, the currents $I_{P1}$ and $I_{P2}$ flowing through the P-type input stage 31A are adjusted with a variable resistive load 38 connected in series to the current mirror 36 in the output stage 32A to thereby adjust the output grayscale reference voltage $V_{REFi}^{OUT}$. It should be noted that the current mirror 36 and the variable resistive load 38 function as a load circuit of the P-type input stage 31A as a whole. The configurations of other portions of the output stage 32A remain unchanged from the output stage 32 in Example 2. In addition, the P-type input stage 31A used in Example 5 does not include the output voltage adjustment circuits 33 and 34, differently from the P-type input stage 31 in Example 2.

More specifically, the variable resistive load 38 includes variable resistors R3 and R4. The variable resistor R3 is connected between the source of the NMOS transistor MN11 and the low-side power line 39, and the variable resistor R4 is connected between the source of the NMOS transistor MN12 and the low-side power line 39. In this example, the resistance values of the variable resistors R3 and R4 are controlled in response to the control signal $S_i$ to thereby adjust the offset voltage of the grayscale amplifier $\mathbf{13}_i$, namely, the output grayscale reference voltage $V_{REFi}^{OUT}$. The configuration of the variable resistor shown in FIG. 6C may be used for the variable resistors R3 and R4.

In the grayscale amplifier $\mathbf{13}_i$ configured as illustrated in FIG. 6B, the currents $I_{P1}$ and $I_{P2}$ flowing through the P-type input stage 31 can be finely adjusted by setting the resistance values of the variable resistors R3 and R4 in the variable resistive load 38 in response to the control signal $S_i$; this allows adjusting the offset voltage of the grayscale amplifier $\mathbf{13}_i$, namely, the output grayscale reference voltage $V_{REFi}^{OUT}$. It is possible to reduce the variations in the grayscale voltages between the driver ICs 3 in the display device 1 by adjusting the output grayscale reference voltage $V_{REFi}^{OUT}$ of each grayscale amplifier 13*i* in each driver IC 3, through storing the set value of the control signal $S_i$ for controlling the variable resistors R3 and R4 as the adjustment data in a non-volatile manner in the output voltage adjustment data register 17 in each driver IC 3 (in the first embodiment) or the external storage device 6 (in the second embodiment).

It should be noted that the variable resistive load 38 may be provided between the nodes N22, N23 and the current mirror 36 instead of between the current mirror 36 and the low-side power line 39. In this case, the variable resistor R3 is connected between the node N22 and the drain of the NMOS transistor MN11, and the variable resistor R4 is connected between the node N23 and the drain of the NMOS transistor MN12.

Example 6

Figure 7A:
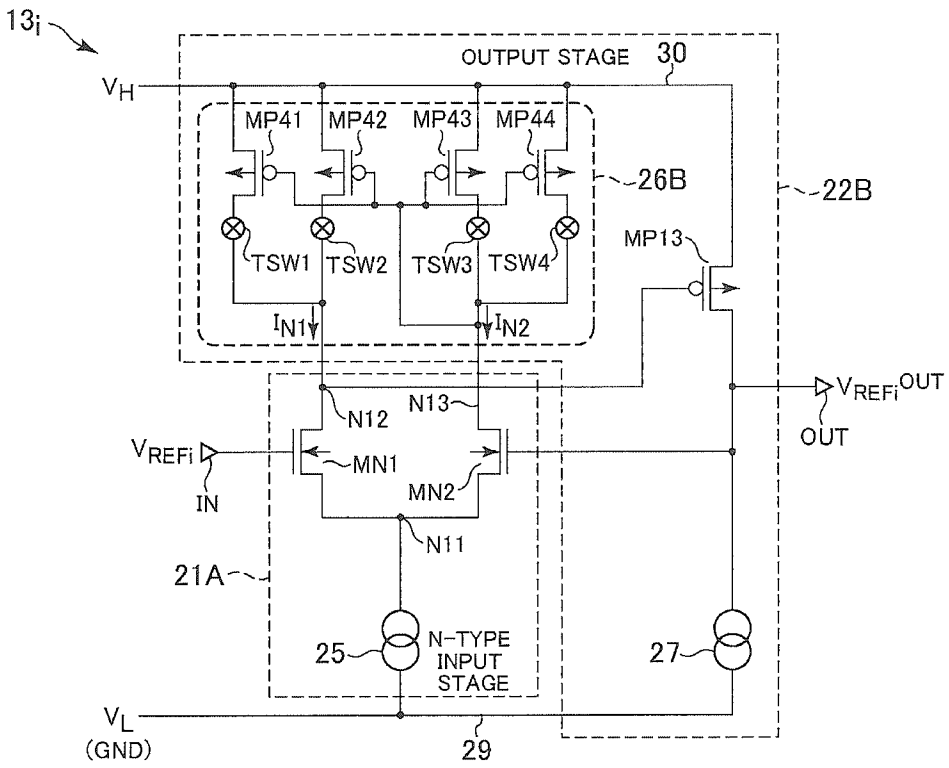
FIG. 7A is a circuit diagram illustrating the configuration of a grayscale amplifier in Example 6.

FIG. 7A is a circuit diagram illustrating a sixth example of the grayscale amplifier $\mathbf{13}_i$, referred to as Example 6, hereinafter. In Example 6, the grayscale amplifier $\mathbf{13}_i$ is configured as a voltage follower including an N-type input stage 21A and an output stage 22B. In the grayscale amplifier $\mathbf{13}_i$ in Example 6, a current mirror 26B which functions as a load circuit of the N-type input stage 21A in the output stage 22B is provided with the function of adjusting the currents $I_{N1}$ and $I_{N2}$ to thereby adjust the output grayscale reference voltage $V_{REFi}^{OUT}$. The configurations of other portions of the output stage 22B remain unchanged from the output stage 22 in Example 1. It should be noted that the N-type input stage 21A used in the grayscale amplifier $\mathbf{13}_i$ in Example 6 has the same configuration as the N-type input stage 21A used in the grayscale amplifier $\mathbf{13}_i$ in Example 4; the output voltage adjustment circuits 23 and 24 are not provided for the N-type input stage 21A.

More specifically, in Example 6, the current mirror 26B includes PMOS transistors MP41 to MP44 and switches TSW1 to TSW4. The gates of the PMOS transistors MP41 to MP44 are commonly connected to each other and the commonly-connected gates are connected to one of the nodes N12 and N13 (in this embodiment, connected to the node N13). The PMOS transistor MP41 and the switch TSW1 are connected in series between the node N12 and the high-side power line 30 and the PMOS transistor MP42 and the switch TSW2 are connected in series between the node N12 and the high-side power line 30. Here, the PMOS transistor MP41 and the switch TSW1 are connected in parallel to the PMOS transistor MP42 and the switch TSW2. The PMOS transistor MP43 and the switch TSW3 are connected in series between the node N13 and the high-side power line 30 and the PMOS transistor MP44 and the switch TSW4 are connected in series between the node N13 and the high-side power line 30. Here, the PMOS transistor MP43 and the switch TSW3 are connected in parallel to the PMOS transistor MP44 and the switch TSW4.

It should be noted that, although FIG. 7A illustrates the configuration in which the switch TSW1 is connected between the node N12 and the PMOS transistor MP41 and the switch TSW2 is connected between the node N12 and the PMOS transistor MP42, the switch TSW1 may be connected between the source of the PMOS transistor MP41 and the high-side power line 30, and the switch TSW2 may be connected between the source of the PMOS transistor MP42 and the high-side power line 30. Similarly, the switch TSW3 may be connected between the source of the PMOS transistor MP43 and the high-side power line 30, and the switch TSW4 may be connected between the source of the PMOS transistor MP44 and the high-side power line 30.

The design of the gate widths of the PMOS transistors MP41 to MP44 is related to the adjustment of the currents and $I_{N2}$. In one example, the PMOS transistors MP41 and MP43 are formed to have substantially the same gate width, and the PMOS transistors MP42 and MP44 are formed to have substantially the same gate width. Here, the term "substantially" means that the inevitable variance generated in the manufacturing process is ignored. Also, the gate widths of the PMOS transistors MP41 and MP42 are designed to differ from each other, and the gate widths of the PMOS transistors MP43 and MP44 are designed to differ from each other. Designing the gate widths in this way allows enlarging the adjustment range of the currents $I_{N1}$ and $I_{N2}$.

The grayscale amplifier $\mathbf{13}_i$ configured as illustrated in FIG. 7A can adjust the offset voltage of the grayscale amplifier 13*i*, namely, the output grayscale reference voltage $V_{REFi}^{OUT}$ by switching the switches TSW1 to TSW4 of the current mirror 26B in response to the control signal $S_i$. It is possible to reduce the variations in the grayscale voltages between the driver ICs 3 in the display device 1 by adjusting the output grayscale reference voltage $V_{REFi}^{OUT}$ of each grayscale amplifier 13*i* in each driver IC 3, through storing the set value of the control signal $S_i$ for controlling the switches TSW1 to TSW4 as the adjustment data in a non-volatile manner in the output voltage adjustment data register 17 in each driver IC 3 (in the first embodiment) or the external storage device 6 (in the second embodiment).

It should be noted that the number of the PMOS transistors connected between the node N12 and the high-side power line 30 is not limited to two in the current mirror 26B; the number of the PMOS transistors connected between the node N12 and the high-side power line 30 and may be three or more. In this case, a switch is connected in series to each PMOS transistor between the node N12 and the high-side power line 30, and the switch is set to the on-state or off-state in response to the control signal $S_i$. Also in the case when three or more PMOS transistors are connected between the node N12 and the high-side power line 30, it is desirable that the gate widths of the PMOS transistors differ from one another. Similarly, the number of the PMOS transistors connected between the node N13 and the high-side power line 30 is not limited to two; the number of the PMOS transistors connected between the node N13 and the high-side power line 30 may be three or more. In this case, the switch is connected in series to each PMOS transistor between the node N13 and the high-side power line 30, and the switch is set to the on-state or off-state in response to the control signal $S_i$. Also in the case when three or more PMOS transistors are connected between the node N13 and the high-side power line 30, it is desirable that the gate widths of the PMOS transistors differ from one another.

Example 7

Figure 7B:
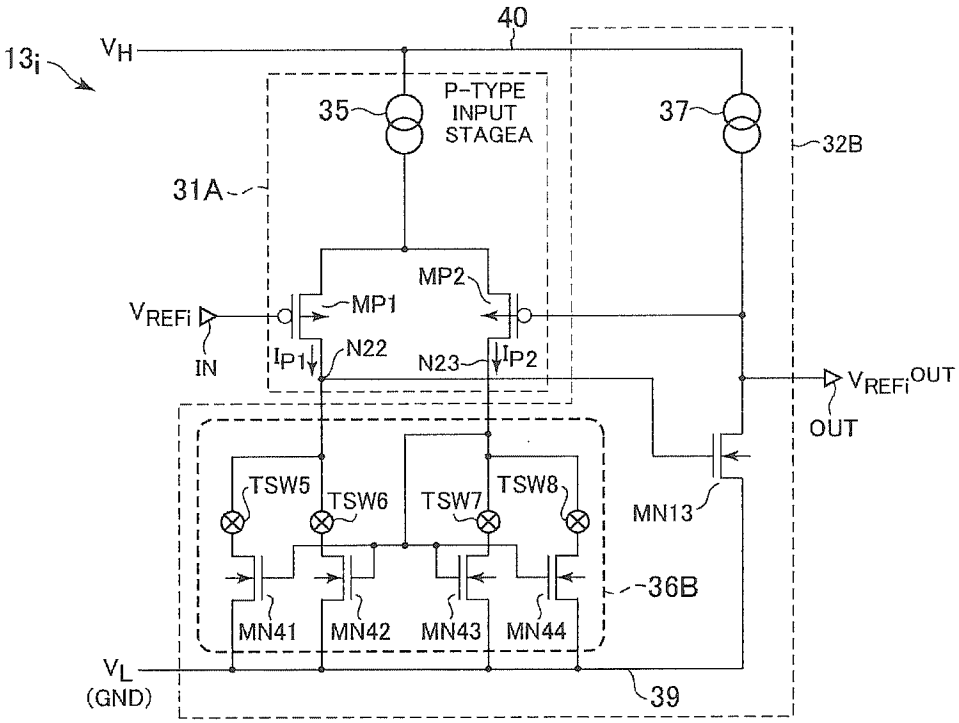
FIG. 7B is a circuit diagram illustrating the configuration of a grayscale amplifier in Example 7.

FIG. 7B is a circuit diagram illustrating a seventh example of the grayscale amplifier $\mathbf{13}_i$, referred to as Example 7, hereinafter. In Example 7, the grayscale amplifier $\mathbf{13}_i$ is configured as a voltage follower including a P-type input stage 31A and an output stage 32B. In the grayscale amplifier $\mathbf{13}_i$ in Example 7, a current mirror 36B which functions as a load circuit of the P-type input stage 31A in the output stage 32B is provided with the function of adjusting the currents $I_{P1}$ and $I_{P2}$ to thereby adjust the output grayscale reference voltage $V_{REFi}^{OUT}$. The configurations of other portions of the output stage 32B remain unchanged from the output stage 32 in Example 1. It should be noted that the P-type input stage 31A used in the grayscale amplifier $\mathbf{13}_i$ in Example 7 has the same configuration as the P-type input stage 31A used in the grayscale amplifier $\mathbf{13}_i$ in Example 5; the output voltage adjustment circuits 33 and 34 are not provided for the P-type input stage 31A.

More specifically, in Example 7, the current mirror 36B includes NMOS transistors MN41 to MN44 and switches TSW5 to TSW8. The gates of the NMOS transistors MN41 to MN44 are commonly connected to each other and the commonly-connected gates are connected to one of the nodes N22 and N23 (in this embodiment, connected to the node N23). The NMOS transistor MN41 and the switch TSW5 are connected in series between the node N22 and the low-side power line 39 and the NMOS transistor MN42 and the switch TSW6 are connected in series between the node N22 and the low-side power line 39. Here, the NMOS transistor MN41 and the switch TSW5 are connected in parallel to the NMOS transistor MN42 and the switch TSW6. The NMOS transistor MN43 and the switch TSW7 are connected in series between the node N23 and the low-side power line 39 and the NMOS transistor MN44 and the switch TSW8 are connected in series between the node N23 and the low-side power line 39. Here, the NMOS transistor MN43 and the switch TSW7 are connected in parallel to the NMOS transistor MN44 and the switch TSW8.

It should be noted that, although FIG. 7B illustrates the configuration in which the switch TSW5 is connected between the node N22 and the NMOS transistor MN41 and the switch TSW6 is connected between the node N22 and the NMOS transistor MN42, the switch TSW5 may be connected between the source of the NMOS transistor MN41 and the low-side power line 39, and the switch TSW6 may be connected between the source of the NMOS transistor MN42 and the low-side power line 39. Similarly, the switch TSW7 may be connected between the source of the NMOS transistor MN43 and the low-side power line 39, and the switch TSW8 may be connected between the source of the NMOS transistor MN44 and the low-side power line 39.

The design of the gate widths of the NMOS transistors MN41 to MN44 is related to the adjustment of the currents $I_{P1}$ and $I_{P2}$. In one example, the NMOS transistors MN41 and MN43 are formed to have substantially the same gate width, and the NMOS transistors MN42 and MN44 are formed to have substantially the same gate width. Here, the term "substantially" means that the inevitable variance generated in the manufacturing process is ignored. Also, the gate widths of the NMOS transistors MN41 and MN42 are designed to differ from each other, and the gate widths of the NMOS transistors MN43 and MN44 are designed to differ from each other. Designing the gate width in this way allows enlarging the adjustment range of the currents $I_{P1}$ and $I_{P2}$.

The grayscale amplifier $\mathbf{13}_i$ configured as illustrated in FIG. 7B can adjust the offset voltage of the grayscale amplifier $\mathbf{13}_i$, namely, the output grayscale reference voltage $V_{REFi}^{OUT}$ by switching the switches TSW5 to TSW8 of the current mirror 36B in response to the control signal $S_i$. It is possible to reduce the variations in the grayscale voltages between the driver ICs 3 in the display device 1 by adjusting the output grayscale reference voltage $V_{REFi}^{OUT}$ of each grayscale amplifier 13*i* in each driver IC 3, through storing the set value of the control signal $S_i$ for controlling the switches TSW5 to TSW8 as the adjustment data in a non-volatile manner in the output voltage adjustment data register 17 in each driver IC 3 (in the first embodiment) or the external storage device 6 (in the second embodiment).

It should be noted that the number of the NMOS transistors connected between the node N22 and the low-side power line 39 is not limited to two in the current mirror 36B; the number of the NMOS transistors connected between the node N22 and the low-side power line 39 may be three or more. In this case, a switch is connected in series to each PMOS transistor between the node N22 and the low-side power line 39, and the switch is set to the on-state or off-state in response to the control signal $S_i$. Also in the case when three or more NMOS transistors are connected between the node N22 and the low-side power line 39, it is desirable that the gate widths of the NMOS transistors differ from one another. Similarly, the number of the NMOS transistors connected between the node N23 and the low-side power line 39 is not limited to two; the number of the NMOS transistors connected between the node N23 and the low-side power line 39 may be three or more. In this case, a switch is connected in series to each NMOS transistor between the node N23 and the low-side power line 39, and the switch is set to the on-state or off-state in response to the control signal $S_i$. Also in the case when three or more NMOS transistors are connected between the node N23 and the low-side power line 39, it is desirable that the gate widths of the NMOS transistors differ from one another.

Although specific embodiments and examples of the present invention have been described in detail, the present invention should not be construed to be limited to the above-described embodiments and examples. It would be apparent to the person skilled in the art that the present invention may be implemented together with various modifications. For example, although various embodiments of the display device 1 including the liquid crystal panel 2 are described above, the present invention may be applied to a panel display device in which a different displaying panel is driven by driver ICs (display panel drivers) and the grayscale voltages are generated in the driver ICs. Also, it would be also easily understood by the person skilled in the art that the configurations of the output stages in Examples 1 to 7 may be variously modified in light of architectonic reasons.

What is claimed is:

1. A display panel driver, comprising:

a grayscale amplifier receiving an input grayscale reference voltage and generating an output grayscale reference voltage corresponding to said input grayscale reference voltage;

a voltage dividing resistor receiving said output grayscale reference voltage and generating a plurality of grayscale voltages by using said received output grayscale reference voltage;

a decoder circuit selecting grayscale voltages from among said plurality of grayscale voltages in response to image data and outputting said selected grayscale voltages; and an output circuit outputting drive voltages corresponding to said selected grayscale voltages to output terminals to be connected to source lines of a display panel, wherein said grayscale amplifier is configured such that said output grayscale reference voltage is adjustable by adjusting an offset voltage of said grayscale amplifier, wherein said grayscale amplifier includes:

an input node receiving said input grayscale reference voltage;

an input stage;

an output stage; and an output node outputting said output grayscale reference voltage, wherein said input stage comprises:

a first MOS transistor having a source connected to a first node, a gate connected to said input node and a drain connected to a second node;

a second MOS transistor having a source connected to said first node, a gate connected to said output node and a drain connected to a third node; and first and second output voltage adjustment circuits, wherein said output stage is configured to output said output grayscale reference voltage from said output node in response to a first current flowing through said second node and a second current flowing through said third node, wherein said first output voltage adjustment circuit includes at least one adjustment leg connected between said first and second nodes, wherein said first adjustment leg comprises:

a first switch; and a third MOS transistor having a gate connected to said input node, wherein said first switch and said third MOS transistor are connected in series between said first and second nodes, wherein said second output voltage adjustment circuit includes at least one second adjustment leg connected between said first and third nodes, wherein said second adjustment leg comprises:

a second switch and a fourth MOS transistor having a gate connected to said output node, wherein said second switch and said fourth MOS transistor are connected in series between said first and third node, and wherein said first and second switches are controlled in response to said control signal.

2. The display panel driver according to claim 1, wherein the offset voltage of said grayscale amplifier is controlled in response to a control signal generated in response to adjustment data stored in a non-volatile manner.

3. The display panel driver according to claim 2, further comprising:

a storage section storing the adjustment data in the non-volatile manner, wherein said storage section, said grayscale amplifier, said voltage dividing resistor, said decoder circuit and said output circuit are monolithically integrated.

4. The display panel driver according to claim 1, wherein said input stage further comprises a constant current source which draws or supplies a constant current from or to said first node.

5. A display device, comprising:

a display panel; and a plurality of display panel drivers, wherein each of said plurality of display panel drivers includes:

a grayscale amplifier receiving an input grayscale reference voltage and generating an output grayscale reference voltage corresponding to said input grayscale reference voltage;

a voltage dividing resistor receiving said output grayscale reference voltage and generating a plurality of grayscale voltages by using said received output grayscale reference voltage;

a decoder circuit selecting grayscale voltages from among said plurality of grayscale voltages in response to image data and outputting said selected grayscale voltages; and an output circuit outputting drive voltages corresponding to said selected grayscale voltages to output terminals to be connected to source lines of said display panel, wherein said grayscale amplifier is configured such that said output grayscale reference voltage is adjustable by adjusting an offset voltage of said grayscale amplifier, wherein said grayscale amplifier includes:

an input node receiving said input grayscale reference voltage;

an input stage;

an output stage; and an output node outputting said output grayscale reference voltage, wherein said input stage comprises:

a first MOS transistor having a source connected to a first node, a gate connected to said input node and a drain connected to a second node;

a second MOS transistor having a source connected to said first node, a gate connected to said output node and a drain connected to a third node; and first and second output voltage adjustment circuits, wherein said output stage is configured to output said output grayscale reference voltage from said output node in response to a first current flowing through said second node and a second current flowing through said third node, wherein said first output voltage adjustment circuit includes at least one adjustment leg connected between said first and second nodes, wherein said first adjustment leg comprises:

a first switch; and a third MOS transistor having a gate connected to said input node, wherein said first switch and said third MOS transistor are connected in series between said first and second nodes, wherein said second output voltage adjustment circuit includes at least one second adjustment leg connected between said first and third nodes, wherein said second adjustment leg comprises:

a second switch and a fourth MOS transistor having a gate connected to said output node, wherein said second switch and said fourth MOS transistor are connected in series between said first and third node, and wherein said first and second switches are controlled in response to said control signal.

6. The display device according to claim 5, wherein the offset voltage of said grayscale amplifier is controlled in response to a control signal generated in response to adjustment data stored in a non-volatile manner.

7. A display device, comprising:

a display panel; and a plurality of display panel drivers, wherein each of said plurality of display panel drivers comprises:

a grayscale amplifier receiving an input grayscale reference voltage and generating an output grayscale reference voltage corresponding to said input grayscale reference voltage, said grayscale amplifier comprising a plurality of controllable devices, each responsive to an offset voltage adjustment signal, that adjust an offset voltage of said grayscale amplifier;

a voltage dividing resistor receiving said output grayscale reference voltage and generating a plurality of grayscale voltages by using said received output grayscale reference voltage;

a decoder circuit selecting grayscale voltages from among said plurality of grayscale voltages in response to image data and outputting said selected grayscale voltages; and an output circuit outputting drive voltages corresponding to said selected grayscale voltages to output terminals to be connected to source lines of said display panel, wherein said grayscale amplifier includes:

an input node receiving said input grayscale reference voltage;

an input stage;

an output stage; and an output node outputting said output grayscale reference voltage, wherein said input stage comprises:

a first MOS transistor having a source connected to a first node, a gate connected to said input node and a drain connected to a second node;

a second MOS transistor having a source connected to said first node, a gate connected to said output node and a drain connected to a third node; and first and second output voltage adjustment circuits, wherein said output stage is configured to output said output grayscale reference voltage from said output node in response to a first current flowing through said second node and a second current flowing through said third node, wherein said first output voltage adjustment circuit includes at least one adjustment leg connected between said first and second nodes, wherein said first adjustment leg comprises:

a first switch; and a third MOS transistor having a gate connected to said input node, wherein said first switch and said third MOS transistor are connected in series between said first and second nodes, wherein said second output voltage adjustment circuit includes at least one second adjustment leg connected between said first and third nodes, wherein said second adjustment leg comprises:

a second switch and a fourth MOS transistor having a gate connected to said output node, wherein said second switch and said fourth MOS transistor are connected in series between said first and third node, and wherein said first and second switches are controlled in response to said control signal.

8. The display device according to claim 7, further comprising a non-volatile memory device to store adjustment data providing offset voltage adjustment data for offset voltage adjustment signals to adjust said offset voltage.

9. The display device according to claim 8, wherein said non-volatile memory device comprises a memory device component within each said display panel driver.

10. The display device according to claim 8, wherein said non-volatile memory device comprises a memory device used to control each grayscale amplifier of a plurality of grayscale amplifiers.

11. The display device according to claim 7, wherein said plurality of controllable devices comprises a plurality of switches, each respectively responsive to an offset voltage adjustment signal.

12. The display device according to claim 11, wherein said grayscale amplifier comprises a plurality of transistors interconnected in a parallel configuration, each said transistor respectively switched by a switch serially-connected with the transistor, said serially-connected switch comprising one controllable device of said plurality of controllable devices, each of the serially-connected switches being responsive to an offset voltage adjustment signal.

* * * * *